US005322292A

United States Patent [19]

Dileva et al.

[11] Patent Number: 5,322,292

[45] Date of Patent: Jun. 21, 1994

[54] METHOD OF PLAYING A BASEBALL BOARD GAME

[76] Inventors: Steven G. Dileva, 10 Curlin La., St. James, N.Y. 11780; Susan P. Johnson, 41 Westbury St., East Islip, N.Y. 11730

[21] Appl. No.: 55,359

[22] Filed: May 3, 1993

[51] Int. Cl.[5] ..... A63F 3/00

[52] U.S. Cl. ..... 273/244; 273/256; 273/93 C

[58] Field of Search ..... 273/244, 247, 246, 248, 273/256, 93 C

[56] References Cited

U.S. PATENT DOCUMENTS 4,211,419 7/1980 Larson ..... 273/248
4,354,684 10/1982 McKinley ..... 273/256
5,135,230 8/1992 Denman ..... 273/244

*Primary Examiner*—Benjamin H. Layno
*Attorney, Agent, or Firm*—Galgano & Burke

[57] ABSTRACT

A baseball board game including a plurality of tokens, each of which represent one of the players, a random number generator, a multiplicity of play money, and a game board having a baseball-like playing field and a multiplicity of playing spaces formed on the baseball-like playing field which cooperatively define a continuous closed path in the form of a baseball diamond along which the tokens are moveable in random increments. The multiplicity of spaces includes a starting corner space representing home plate and three additional corner spaces representing first base, second base and third base, respectively, a first group of spaces having monetary gains specified thereon associated with certain baseball-related events in a baseball player's life both on and off the field which have a positive pecuniary effect on a baseball player and a second group of space having monetary penalties specified thereon associated with certain baseball events on and off the field in a baseball player's life which have a negative pecuniary effect on a baseball player.

3 Claims, 2 Drawing Sheets

METHOD OF PLAYING A BASEBALL BOARD GAME

BACKGROUND OF THE INVENTION

The present invention relates to a baseball board game. More particularly, it relates to a baseball board game which highlights the monetary, personal and business aspects of professional baseball players, both on and off the field, in a simulated traditional baseball game-like setting.

A variety of baseball board games have been proposed. For example, Seale, U.S. Pat. No. 2,769,639 discloses a game which attempts to simulate a traditional baseball game setting with pitchers and hitters of varying ability and where the outcome of the game is based on the game player's ability as a "manager" to make appropriate managerial moves, than on the elements of chance which are reduced to a minimum degree. Other board games have a sports game motif also have a more traditional rectangular path around a game board and deal, e.g., with the acquisition of teams and players (U.S. Pat. Nos. 4,010,957 and 4,486,022) or the ability of the game players to spell for educational purposes (U.S. Pat. No. 4,000,897). However, so far as is known, no presently available board game provides a simulated traditional baseball game-like setting while highlighting the total personal and business aspects of the game, both on and off the field, from a player's perspective in a simple and yet highly manner as herein proposed.

SUMMARY OF THE INVENTION

Accordingly, it is an object of the present invention to provide a novel baseball board game which highlights the business aspects of the game from a player's perspective in a simulated, traditional baseball game setting.

It is a further object of this invention to provide such a novel board game which is relatively simple and easy to play and which is both entertaining as well as educational.

It is another object of the present invention to provide such a novel board game which may be economically fabricated and is suitable for both children and adults.

Certain of the foregoing and related objects are readily attained according to the present invention by the provision of a baseball board game which includes a plurality of tokens, each of which represent one of the players, a random number generator, a multiplicity of play money, and a game board having a baseball-like playing field and a multiplicity of playing spaces formed on the baseball-like playing field which cooperatively define a continuous closed path in the form of a baseball diamond along which the tokens are moveable in random increments. The multiplicity of spaces including a starting corner space representing home plate and three additional corner spaces representing first base, second base and third base, respectively, a first group of spaces having monetary gains specified thereon, associated with certain baseball events in a baseball player's life both on and off the field which have a positive pecuniary effect on a baseball player and a second group of spaces having monetary penalties specified thereon associated with certain baseball events in a baseball player's life which have a negative pecuniary effect on a baseball player.

Preferably, the game also includes a nine inning score card, and the multiplicity of play money contains bills of various denominations. Most advantageously, the multiplicity of cards composed of plural sets of cards containing different numbers from one to six.

BRIEF DESCRIPTION OF THE DRAWINGS

Other objects and features of the present invention will become apparent from the following detailed description considered in connection with the accompanying drawings which disclose one embodiment of the present invention. It should be understood, however, that the drawings are designed for the purpose of illustration only and not as a definition of the limits of the invention.

In the drawings, wherein similar reference characters denote similar elements throughout the several views.

DETAILED DESCRIPTION OF THE PREFERRED EMBODIMENTS

Figure 1:
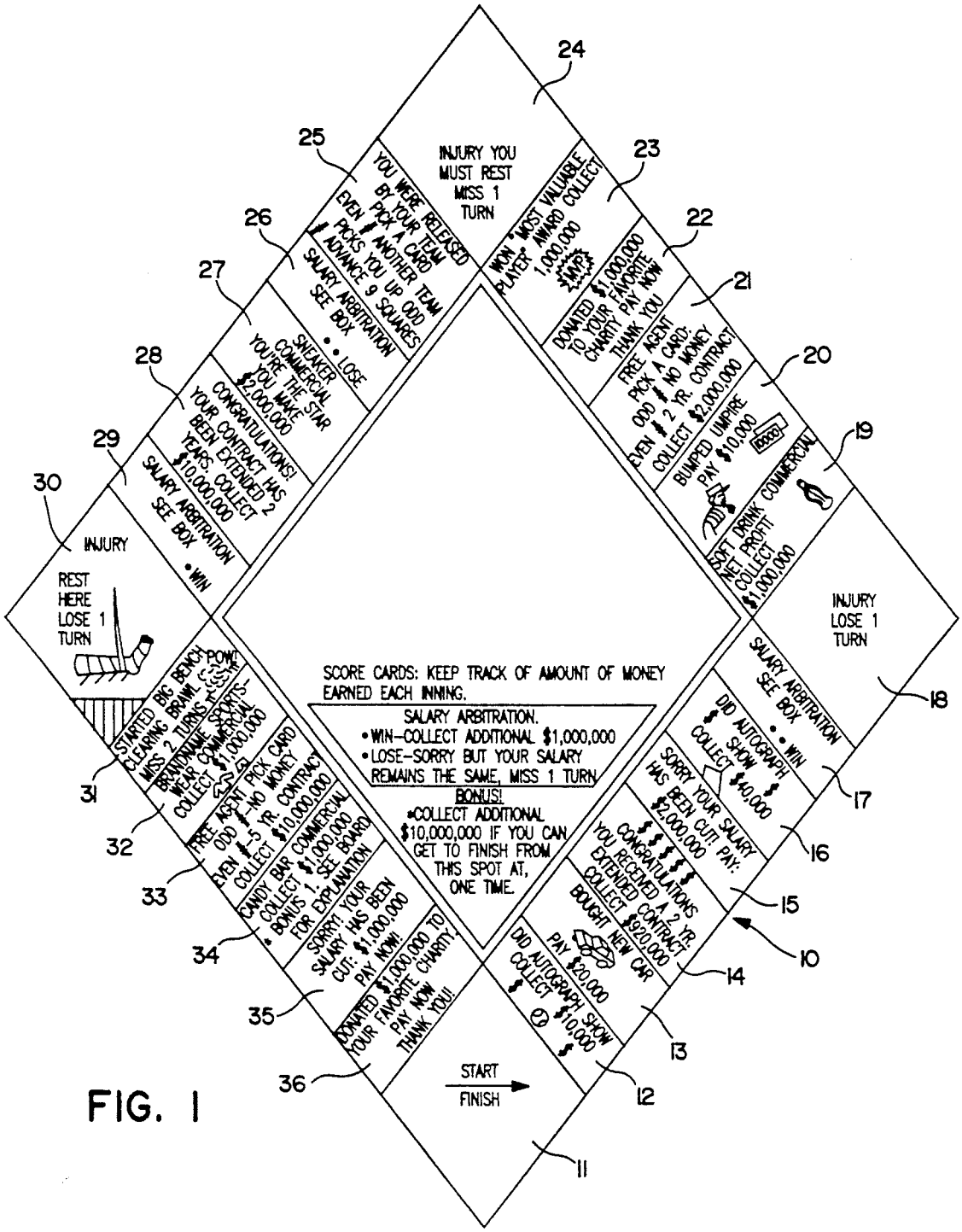
FIG. 1 is a top plan view of the game board embodying the present invention.

Referring now in detail to the drawings and, in particular FIG. 1 thereof, therein illustrated is a novel baseball board game embodying the present invention which includes a generally baseball diamond shaped, flat game board 10. Game board 10 has delineated thereon a continuous closed path about the periphery thereof defined by twenty six successive playing spaces 11–36 which, except for the corner starting space 11 labeled "start - finish" (which also serves as home plate), provides player instructions for the player who lands on the space. The specific instructions provides for each space 12–36 are listed below in TABLE 1.

TABLE 1

INSTRUCTIONS ON PLAYING SPACES 12-36

| SPACE NO. | INSTRUCTIONS |
|---|---|
| 12 | DID AUTOGRAPH SHOW - COLLECT $10,000 |
| 13 | BOUGHT NEW CAR - PAY $20,000 |
| 14 | CONGRATULATIONS - YOU RECEIVE A 2 YEAR EXTENDED CONTRACT - COLLECT $920,000 |
| 15 | SORRY! YOUR SALARY HAS BEEN CUT! PAY: $2,000,000 |
| 16 | DID AUTOGRAPH SHOW - COLLECT $40,000 |
| 17 | SALARY ARBITRATION - SEE BOX * WIN |
| 18 | INJURY - LOSE 1 TURN |
| 19 | SOFT DRINK COMMERCIAL - NET PROFIT COLLECT $1,000,000 |
| 20 | BUMPED UMPIRE - PAY $10,000 |
| 21 | FREE SORRY! - PICK A CARD: ODD #, NO MONEY - EVEN #, 2 YEAR CONTRACT - COLLECT $2,000,000 |
| 22 | DONATED $1,000,000 TO YOUR FAVORITE CHARITY - PAY NOW - THANK YOU |
| 23 | WON "MOST VALUABLE PLAYER" AWARD - COLLECT $1,000,000 |
| 24 | INJURY - YOU MUST REST - MISS 1 TURN |

TABLE 1-continued

| INSTRUCTIONS ON PLAYING SPACES 12-36 | |
|---|---|
| SPACE NO. | INSTRUCTIONS |
| 25 | YOU WERE RELEASED BY YOUR TEAM - PICK A CARD - EVEN #, ANOTHER TEAM PICKS YOU UP - ODD #, ADVANCE 9 SPACES |
| 26 | SALARY ARBITRATION - SEE BOX * LOSE |
| 27 | SNEAKER COMMERCIAL - YOU'RE THE STAR - YOU MAKE $2,000,000 |
| 28 | CONGRATULATIONS! YOUR CONTRACT HAS BEEN EXTENDED 2 YEARS - COLLECT $10,000,000 |
| 29 | SALARY ARBITRATION - SEE BOX * WIN |
| 30 | INJURY - REST HERE - LOSE 1 TURN |
| 31 | STARTED BIG BENCH CLEARING BRAWL - MISS 2 TURNS |
| 32 | BRAND NAME SPORTSWEAR COMMERCIAL - COLLECT $1,000,000 |
| 33 | FREE AGENT - PICK CARD - ODD #, NO MONEY - EVEN #, 5 YEAR CONTRACT - COLLECT $10,000,000 |
| 34 | CANDY BAR COMMERCIAL - COLLECT $1,000,000* BONUS 1 - SEE BOARD FOR EXPLANATION |
| 35 | SORRY! YOUR SALARY HAS BEEN CUT $1,000,000 - PAY NOW |
| 36 | DONATED $1,000,000 TO YOUR FAVORITE CHARITY - PAY NOW - THANK YOU! |

As can be seen from TABLE 1, the instructions on the playing spaces generally relate to a baseball event in a baseball player's life (both on and off the field), which typically has a monetary benefit or penalty associated therewith. In addition, there are also several spaces associated with an on-field personal event in a baseball player's life—namely, an injury, which places him on the disabled list and results in a loss of turn (spaces 18, 24 and 30) or a game suspension for a fight or brawl (space 31). Three spaces 17, 26, 29 relate to the salary arbitration box in the center of the board and provide a monetary benefit if the player wins arbitration or a loss of turn if he or she loses. Space 34 also provides for a bonus noted in the center of the board if the player lands on home 11 on his or her next turn.

Figure 2:
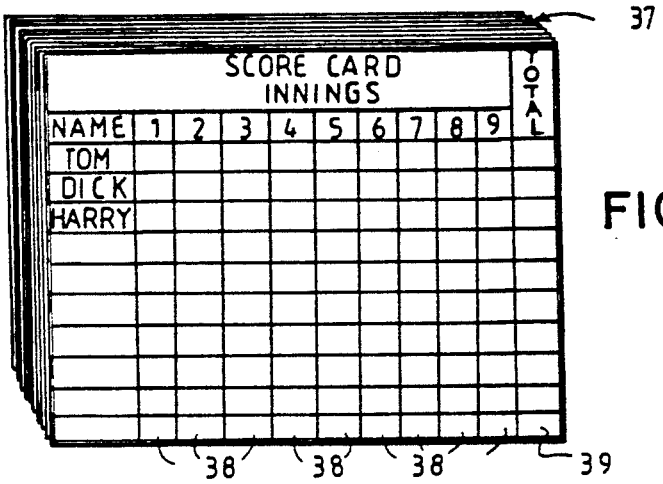
FIG. 2 is a perspective view of the game score pad.

As shown in FIG. 2, the score of the game is kept on a score card pad 37. Pad 37 has a first column 38 for the players' names and nine inning columns 38 labels 1-9 corresponding to the nine innings of a baseball game. Score pad 37 also contains a total column 39 for adding up each players total score.

Figure 3:
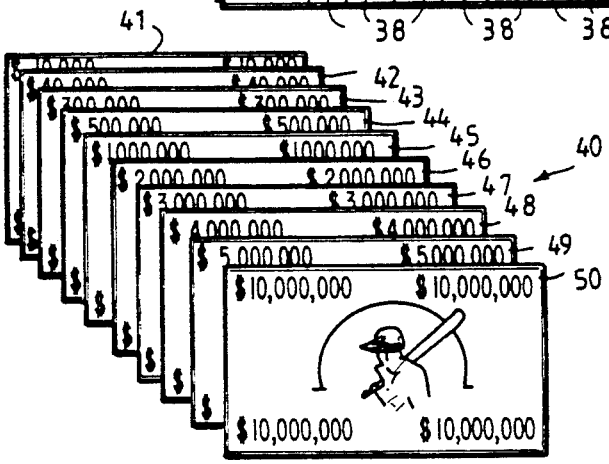
FIG. 3 is a perspective view showing various denominations of play money.

The game also includes play money 40 of various denominations as represented in FIG. 3. In particular, the play money provided preferably consists of sixty-four $10,000 bills 41, thirty-two $40,000 bills 42, twenty-four $300,000 bills 43, twenty-four $500,000 bills 44, twenty-four $1,000,000 bills 45, forty $2,000,000 bills 46, forty $3,000,000 bills 47, forty $4,000,000 bills 48, forty $5,000,000 bills 49, and forty $10,000,000 bills 50.

Figure 4:
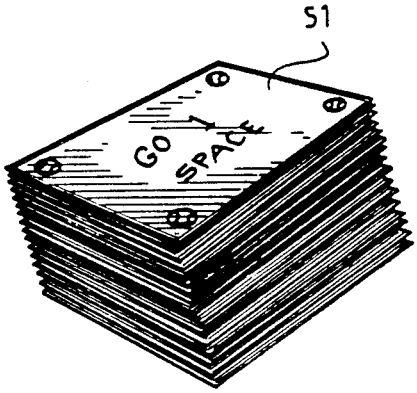
FIG. 4 is a perspective view of the game advance cards.

As shown in FIG. 4, the game includes a stack of forty eight game advance or move cards 51 which show how many spaces (from 1 to 6) a player moves on his turn. The deck of forty eight cards 51 contains eight cards of each number (i.e., eight "go 1 space" cards, eight "go 2 spaces" cards, etc.). Of course, any random number generator (e.g., a die) could be used for this purpose.

Figure 5:
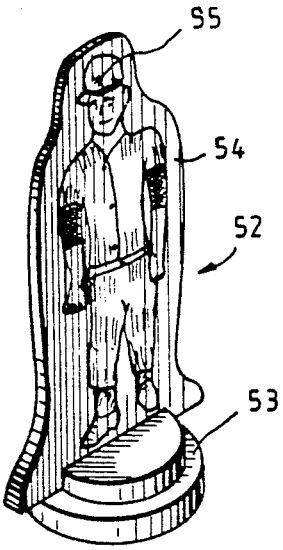
FIG. 5 is a perspective view of a playing piece in the form of a baseball player.
Figure 6:
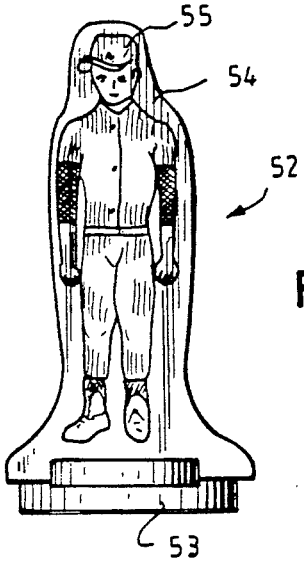
FIG. 6 is a front elevational view of the playing piece shown in FIG. 5.

As shown in FIGS. 5 and 6, each player of the game is provided with a playing piece or game token 52 which consists of a plastic or wooden slotted base 53 which supports an upright planar cardboard or plastic member 54 containing a representation of a baseball player. Each token would be provided with a differently colored base 53 and baseball cap 55 to differentiate between the players (e.g., red, blue, green and yellow).

The object of the game is to be the player with the "highest score" or most money at the end of a "nine inning" game. Each player preferably starts with two million dollars made up of the following bills: one $1,000,000 bill 45, one $500,000 bill 44, one $300,000 bill 43, four $40,000 bills 42 and eight $10,000 bills 41.

To start the game, each player picks a playing piece 52 and places it on home base or the starting-space 11. Each player then picks a card 51 from the stack and the player with the highest card goes first, the player with the second highest card goes second, etc. Each player then moves his token 52 around the board by picking a move or advance card 51 and moving the number of spaces indicated thereon; player movement about the board being in a counterclockwise fashion similar to movement about a baseball diamond successively passing first base, second base, third base and then home base represented by the four corner spaces 18, 24, 30 and 11, respectively. Each player follows the instructions on the space he or she lands, generally resulting in a monetary gain or loss or loss of a turn.

Each complete trip around the board represents an inning of play and, after each inning, the players write down the amount of money they won under the appropriate inning column 38, thereby keeping score on an inning-by-inning basis. The game is complete after nine innings and the players would write down their final scores or money totals in the last total column 39. The player with the highest "score" or "runs", i.e., the player who won the most money, would be declared the winner of the game.

Various modifications may be made as will be apparent to those skilled in the art. For example, the various instructions on the playing field which relate to the "monetary" events in a baseball player's life both on and off the field and the amounts associated therewith can, of course, be modified as desired.

Accordingly, while only one embodiment of the present invention has been shown and described, it is to be understood that many changes and modifications may be made thereunto without departing from the spirit and scope of the invention as disclosed herein.

What is claimed is:

1. A method of playing a baseball board game for a plurality of game players each of said game players representing a single baseball player to simulate the careers of the baseball players represented by said game players competing against each other to make the most money the parts of said game comprising:

a plurality of tokens, each of which represents one of said baseball players;

game board means embodying only events significant to the career and wealth of said baseball players competing against each other having a baseball-like playing field and a multiplicity of playing spaces formed on the baseball-like playing field which cooperatively define a continuous closed path in the form of a baseball diamond along which the tokens are moveable in random increments, said multiplicity of spaces including a starting corner space representing home plate and three additional corner spaces representing first base, second base and third base, respectively, a first group of spaces having monetary gains specified thereon, associated with certain baseball events in a baseball player's life both on and off the field which have a positive pecuniary effect on a baseball player and a second group of spaces having monetary penalties specified thereon associated with certain baseball events in a baseball player's life which have a negative pecuniary effect on a baseball player, all of said spaces defining said events significant to the career and wealth of a baseball player;

score card means for recording the score denominated in money for each inning of play for each of the game players;

a random number generator; and a multiplicity of play money;

the method steps comprising each game player generating a number using said random number generator, each game player moving the token associated therewith around said board according to said generated random number, each trip of a token around said playing field on said board representing a single inning, each game player recording the amount of money earned for each inning, and recording nine innings of score on said score card means, the game player with the most money at the end of nine innings of play being the winner of said game.

2. The method of claim 1, wherein said multiplicity of play money contains bills of various denominations.

3. The method of claim 1, wherein said random number generator comprises a multiplicity of cards composed of plural sets of cards containing different numbers from one to six.

* * * * *